US012584707B2

(12) United States Patent
Kangasniemi et al.

(10) Patent No.: US 12,584,707 B2
(45) Date of Patent: Mar. 24, 2026

(54) FIREARM SUPPRESSOR COVER

(71) Applicant: Polar Apex Oy, Espoo (FI)

(72) Inventors: Juho Kangasniemi, Helsinki (FI); Jan Knutti, Kraainem (BE)

(73) Assignee: Polar Apex Oy, Espoo (FI)

( * ) Notice: Subject to any disclaimer, the term of this patent is extended or adjusted under 35 U.S.C. 154(b) by 0 days.

(21) Appl. No.: 18/869,893

(22) PCT Filed: May 5, 2023

(86) PCT No.: PCT/FI2023/050245
§ 371 (c)(1),
(2) Date: Nov. 27, 2024

(87) PCT Pub. No.: WO2023/233067
PCT Pub. Date: Dec. 7, 2023

(65) Prior Publication Data

US 2025/0341377 A1 Nov. 6, 2025

(30) Foreign Application Priority Data

May 30, 2022 (FI) ..... 20227075

(51) Int. Cl.
*F41A 21/44* (2006.01)
*F41A 21/30* (2006.01)

(52) U.S. Cl.
CPC ..... *F41A 21/44* (2013.01); *F41A 21/30* (2013.01)

(58) Field of Classification Search
CPC ..... F41C 23/16; F41A 21/24; F41A 21/30; F41A 21/44
USPC ..... 89/14.1, 14.2, 14.4
See application file for complete search history.

(56) References Cited

U.S. PATENT DOCUMENTS

| | | | | |
|---|---|---|---|---|
| 1,451,137 | A * | 4/1923 | Baily | F41C 23/16 42/106 |
| 5,005,374 | A * | 4/1991 | Spitler | F25D 3/08 383/110 |
| 9,435,600 | B2 * | 9/2016 | Oliver | F41A 21/24 |
| D813,971 | S | 3/2018 | Aragao | |
| D833,565 | S | 11/2018 | Roberts et al. | |
| 10,480,886 | B2 | 11/2019 | Hibbitts et al. | |
| 2003/0234058 | A1 * | 12/2003 | Tippins | F16L 59/022 138/149 |
| 2010/0170135 | A1 * | 7/2010 | Tompkins | F41A 35/04 42/96 |
| 2012/0167435 | A1 | 7/2012 | Poling | |

(Continued)

FOREIGN PATENT DOCUMENTS

| | | | | |
|---|---|---|---|---|
| EP | 0183432 | A1 * | 6/1986 | F41A 21/44 |
| RU | 2611461 | C1 | 2/2017 | |

(Continued)

*Primary Examiner* — John Cooper
(74) *Attorney, Agent, or Firm* — Espatent Oy

(57) ABSTRACT

A firearm suppressor cover (1), comprising a thermal insulator (3) which is, in use, configured to surround a firearm suppressor (4); and a curved spring (2) which is located at a first end of the cover and pre-bent into a shape of a ring, which is open at one point, the spring (2) being, in use, configured to tighten around the firearm suppressor (4) in order to tighten said thermal insulator (3) around the firearm suppressor (4) and to prevent the longitudinal movement of said thermal insulator (3) in relation to said suppressor (4).

20 Claims, 6 Drawing Sheets

(56) References Cited

U.S. PATENT DOCUMENTS

| | | | | |
|---|---|---|---|---|
| 2014/0059913 | A1 | 3/2014 | Diamond et al. | |
| 2015/0345896 | A1* | 12/2015 | Michal | F41C 23/16 42/75.01 |
| 2017/0153080 | A1 | 6/2017 | Roberts et al. | |
| 2019/0271520 | A1* | 9/2019 | Roberts | F41A 13/12 |
| 2021/0404761 | A1 | 12/2021 | Le Sage | |

FOREIGN PATENT DOCUMENTS

| | | | | |
|---|---|---|---|---|
| WO | WO-2014087401 | A1 * | 6/2014 | F41A 21/44 |
| WO | 2022079641 | A1 | 4/2022 | |

* cited by examiner

FIREARM SUPPRESSOR COVER

FIELD OF THE INVENTION

The application relates generally to firearm suppressor covers.

PRIOR ART

This section illustrates useful background information without admission of any technique described herein representative of the state of the art.

A firearm suppressor silences the noise of a shot from a firearm. It slows the speed of the hot, overpressured gases from burning gunpowder discharging from the barrel of the firearm after the shot, thereby decreasing the noise created. The hot high pressure gases cause the suppressor to become heated. The materials most commonly used in suppressors are aluminium, titanium and steel. When several shots are fired, the suppressor will be heated significantly. This heating also creates other problems, such as strengthening the heat trace revealed to a thermal imager of an enemy as well as heat mirage in the air above the suppressor. Heat mirage hampers the aiming of a firearm, because the sights are usually located on the top of the rifle-type handguns. Firing several shots quickly makes the suppressor dangerously hot for the user, as well as his equipment and environment.

This problem has been resolved by various covers manufactured from heat-resistant fabric insulating the outside of the suppressor, thereby slowing the conduction of heat from the outer casing of the suppressor into the environment. Another solution is to make a hard casing which leaves an air space between the suppressor and the casing. In this case, air is able to cool the suppressor, and the suppressor is able to cool down slightly faster than a thermal cover made from a textile.

The problem with handling a hot suppressor is that the temperature of the suppressor may be 600-800 degrees Celsius. In this case, even a fabric cover might, without a suitable insulator, be hot enough to burn skin, equipment or the environment. Removing and transporting the suppressor while hot is difficult, or even impossible. Another problem is the properties of the materials that are used: plastics and fabrics cannot withstand such temperatures.

Mirage covers and thermal covers for a suppressor are described, for example, in USD833565S1 and US 20170153080. In these covers, air is able to circulate freely between the suppressor and the casing. The attachment to the suppressor is implemented by bands of special shape, to which the casing attaches. Thus, the conduction of heat from the suppressor to the outer casing is decreased. The weakness with such a cover is the softening of the plastic outer casing as the suppressor and the casing are heated. Such a casing cools down well, but when grasping it with a hand or similar, it functions as a thermal insulator, and the casing quickly begins to heat more at the grasping point. Such a casing may break or be impossible to handle after a few dozen fast shots. Such a casing also does not take into consideration the fast and easy removal of the cover from the suppressor, or the thermal insulation for handling or transporting the suppressor.

U.S. Pat. No. 10,480,886 relates to an insulation made integral with the suppressor. The publication mentions a separate suppressor cover, but does not make any commitments as to the attachment solution of the suppressor and cover. Various suppressor cover casings made from fabric and equipped with various ribs, for example, ones made from silicon are widely available on the market. Some of these are intended for single-shot firearms, mainly to prevent heat mirage, and not much consideration is given to the significant heating of the suppressor. Such solutions are found, for example, in US20120167435 and US20140059913.

Now, a novel firearm suppressor cover will be disclosed.

SUMMARY

The accompanying claims define the scope of protection. Any examples and technical specifications of devices and/or products in the description and/or figures, which are not covered by the claims, are not disclosed as embodiments of the invention, but as useful examples or background information for understanding the invention.

According to a first exemplary aspect, a firearm suppressor cover is provided, comprising:

- a thermal insulator which is, in use, configured to surround a firearm suppressor; and
- a curved spring which is located at a first end of the cover and pre-bent into a shape of a ring, which is open at one point, the spring being, in use, configured to tighten around the firearm suppressor in order to tighten said thermal insulator around the firearm suppressor and to prevent a longitudinal movement of said cover in relation to said suppressor.

In some embodiments, the spring is, in use, configured to tighten around the firearm suppressor at a point, where the diameter of the suppressor changes, and/or behind the suppressor, and/or at the step-like point of the suppressor.

In some embodiments, the spring is pre-bent into a circular shape and/or into the shape of a letter C.

In some embodiments, the spring is manufactured from a metal wire with a round cross-section.

In some embodiments, the spring comprises two substantially parallel portions shaped like a letter C that are fixedly connected to each other at their one end and are free of each other at their other end.

In some embodiments, the spring is configured to tighten said thermal insulator around suppressors having different diameters.

In some embodiments, the spring is removably attached to said cover. The cover may have two or more channels for attaching said spring to different points in said cover.

In some embodiments, the cover further comprises a gas shield which is configured to protect from waste gases of a gas port of the firearm and which is attached to the rear part of the cover.

In some embodiments, the thermal insulator is sewn in between fabrics.

In some embodiments, the cover further comprises a second spring located at the other end of the cover.

In some embodiments, the cover comprises three curved springs at different points in the cover.

According to a second exemplary aspect, a gas shield is provided for a firearm suppressor cover. The gas shield is configured to be attached to a rear part of the suppressor cover in order to, in use, protect from waste gases of a gas port of the firearm. In some embodiments, the gas shield comprises a plate which is configured to settle substantially perpendicular in relation to the longitudinal direction of the suppressor cover, when the gas shield is attached to the suppressor cover. Said plate may be manufactured from metal.

According to a third exemplary aspect, a suppressor cover is provided, comprising a gas shield according to the above-described second exemplary aspect.

The rear part of the suppressor cover herein refers to that end of the suppressor which, in use, faces towards a barrel of a firearm. The longitudinal direction of the suppressor cover corresponds to the direction of the barrel of the firearm, when the suppressor cover is attached to a suppressor which is attached to a firearm.

Different non-binding exemplary aspects and embodiments have been illustrated in the foregoing. The above embodiments are used merely to explain selected aspects or steps that may be utilized in various implementations. Some embodiments may be disclosed only with reference to certain aspects. It should be appreciated that corresponding embodiments may apply to other exemplary aspects and embodiments with regard to them as well.

LIST OF FIGURES

Various embodiments will now be described, by way of example only, with reference to the accompanying figures, in which.

DETAILED DESCRIPTION OF THE INVENTION

Figure 1A:
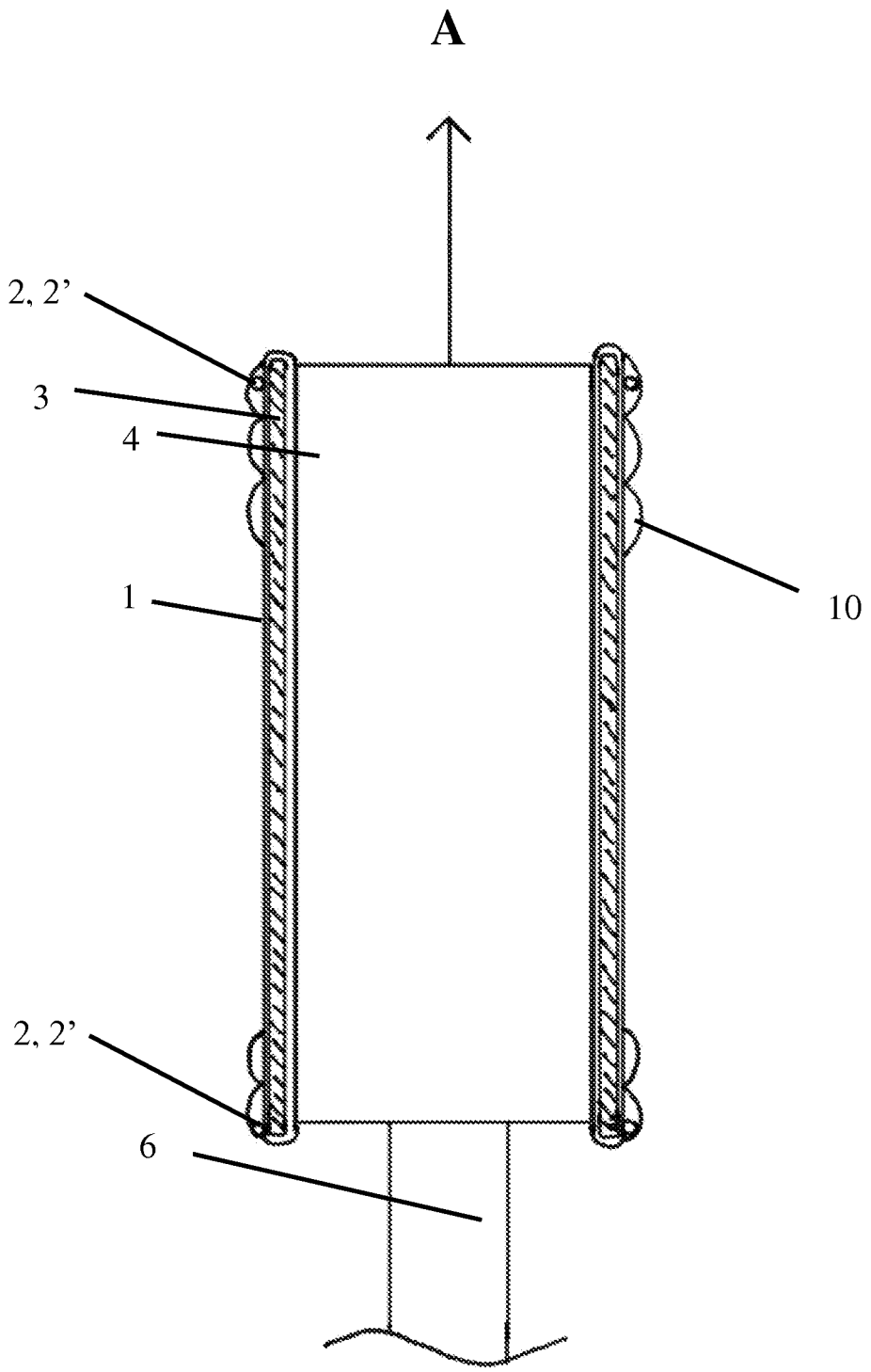
FIGS. 1A-1B show a cross-section, as viewed laterally, of a suppressor cover according to an embodiment, with a suppressor attached to a firearm.

In the following description, like reference signs denote like elements or steps.

The object of a firearm suppressor cover according to the embodiments disclosed herein is to reduce the challenges created by the heat of the suppressor, and to make the suppressor safe to handle and transport, even while hot, without any separate handling means. The problem is resolved by surrounding the firearm suppressor with a thermal insulator inside a protective fabric, the thermal insulator being held in place around the suppressor by flexible tensioners. This makes it possible to handle the suppressor as well as the suppressor cover separately or together. The attachment of the suppressor cover to the suppressor is such that the recoil of the firearm, or a movement caused by the user, will not move the cover away from around the suppressor.

A firearm suppressor cover according to various embodiments comprises a thermal insulator. As the thermal insulator may be used a textile based on, for example, aerogel, carbon fibre wool, basalt or some other material with high heat resistance. The thermal insulator may be sewn in between fabrics. The fabric that is against the suppressor may, depending on the application, be made from, for example, fibreglass, silicate, carbon fibre or some other fabric that withstands high temperatures. The outer fabric of the thermal insulator may be from a suitably heat resistant fabric, such as fabric made from Aramid fibres, or a fabric like the normal nylon fabric used in equipment applications.

The thermal insulator is, for example, a rectangular unit.

A separate protector made from textile material may be further attached over the firearm suppressor cover to achieve a desired colour or patterning. In this way, for example, the suppressor may be camouflaged in its environment.

In an embodiment, the firearm suppressor cover forms, when completed, a cylindrical-shaped unit which is open from its longitudinal side and which flexes around suppressors having different diameters. At a first end of the thermal insulator of the cover there is located a curved spring, pre-bent into a circular shape, which compresses the thermal insulator into a cylindrical form creating the cylinder-shaped cover. There is at least one spring, but there may also be a plurality of springs. For example, there may be a second spring at the other end of the thermal insulator. Alternatively, there may be three or more springs in the cover at different points in the thermal insulator.

Using the spring(s), the structure of the cover flexes when installed onto units with different thicknesses, and also tightens itself onto the suppressor. Thus, a thermally insulating, self-tightening cover is achieved.

In an embodiment, the cover comprises a curved spring located at a first end of the cover and pre-bent into the shape of a ring, which is open at one point. Alternatively or additionally, the shape of the spring in question may be described as circular. The spring is, in use, configured to tighten around a firearm suppressor in order to tighten the thermal insulator around the firearm suppressor. In this way, it is possible to prevent, or at least to reduce, longitudinal movement of the cover in relation to the suppressor, onto which the cover is attached. Longitudinal movement herein refers to a movement in the direction of the barrel of the firearm, and/or a movement in the direction of the trajectory of a projectile.

In an embodiment, a spring is, in use, configured to tighten around the firearm suppressor at a point, where the diameter of the suppressor changes, for example, decreases. Such a point may be, for example, where the suppressor is attached to the barrel of the firearm. Further, such a point may be, for example, at the end of the suppressor.

In an embodiment, one spring is made to compress the suppressor and one spring is compressed behind the suppressor, or at some other step-like point. This improves the ability of the thermal insulator/cover to remain in place during movement, and during continuous firing.

The spring(s) may be removably attached to the cover. In an example, attachment points are left in the uppermost fabric layer of the cover, or channels are sewn in for one or more springs. The point of the springs in the cover may be changed, whereby they can be installed at different points depending on the length of the suppressor.

FIG. 1A shows a cross-section, as viewed laterally, of a suppressor cover 1 according to an embodiment, with a suppressor attached to a firearm.

The figure shows the barrel 6 of the firearm, a suppressor 4 and the cover 1. The cover 1 comprises a thermal insulator 3, channels 10 sewn into an upper surface of the cover 1, a spring 2, 2' placed into the outermost channels 10, i.e. into the channel which is closest to the barrel 6 of the firearm, and the channel which is furthest from the barrel 6 of the firearm.

For the sake of clarity, FIG. 1A does not show the inner structure of the suppressor. The figure is cut at the barrel of the firearm. An arrow A shows a trajectory of a bullet.

Figure 1B:
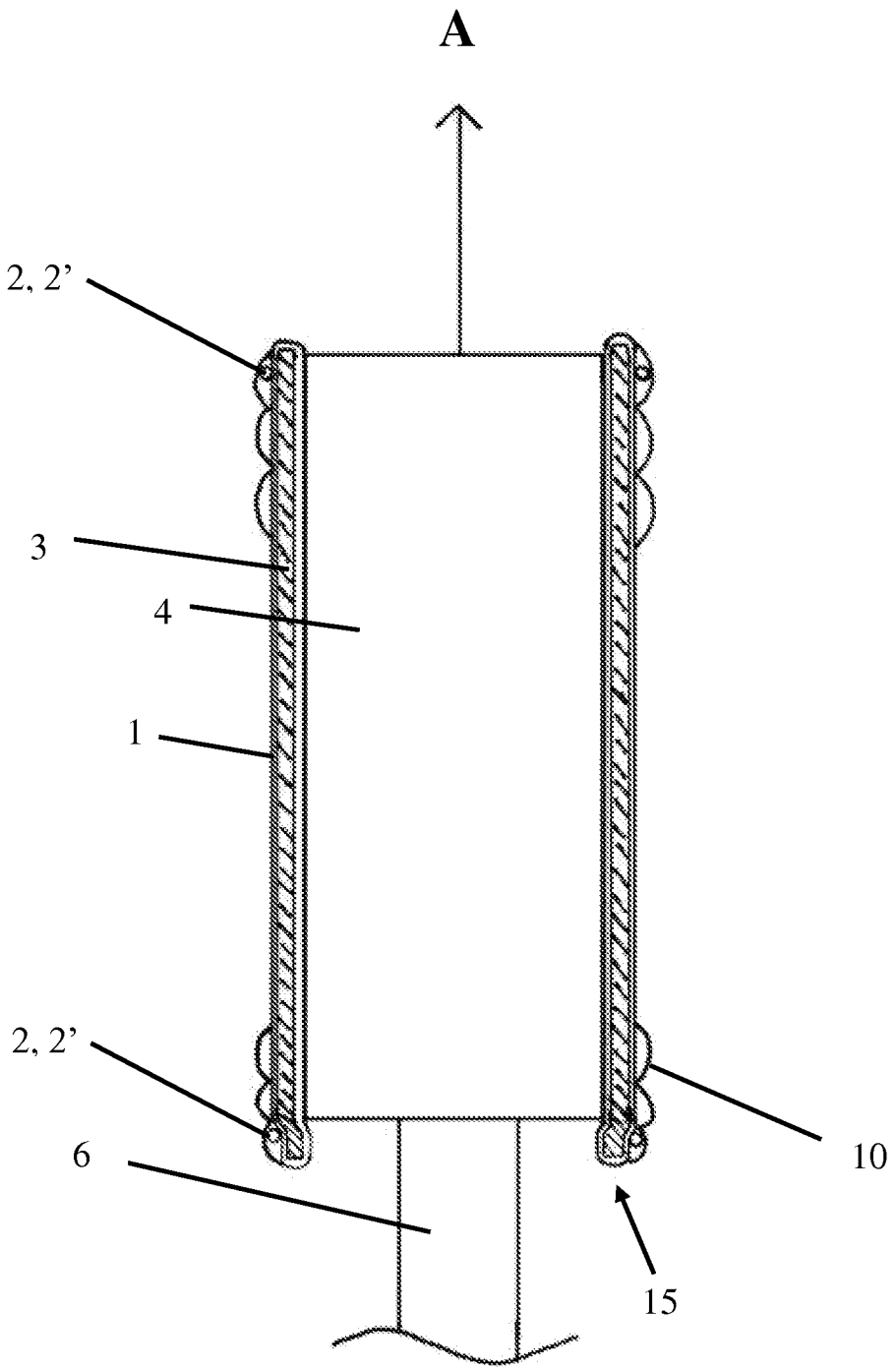

FIG. 1B shows a suppressor cover 1 according to an embodiment, in which the spring 2, 2' is compressed behind the suppressor at a point 15. Herein, the spring 2, 2' has thus tightened around the suppressor at the point, where the diameter of the suppressor changes. In this way, the spring 2, 2' may improve the ability to prevent, or at least reduce, a longitudinal movement of the cover in relation to the suppressor.

Figure 1C:
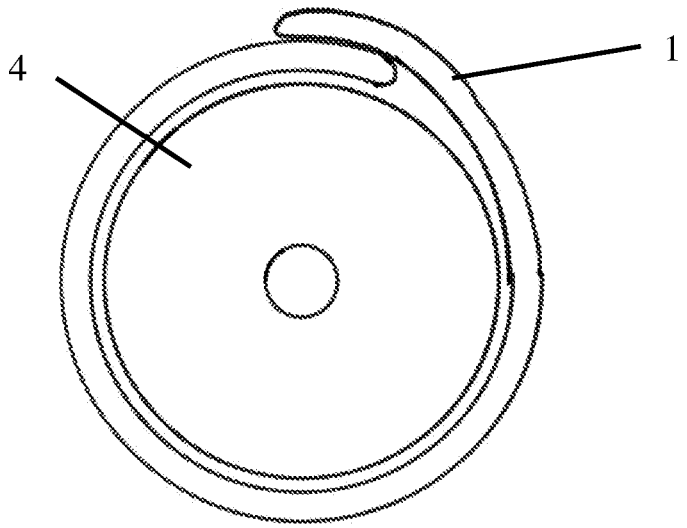
FIG. 1C shows a cross-section, as viewed from the direction of the barrel of the firearm, of a suppressor cover according to an embodiment, with a suppressor attached to a firearm.

FIG. 1C shows a cross-section, as viewed from the direction of the barrel of the firearm, of a suppressor cover according to an embodiment, with the suppressor attached to a firearm.

The figure shows the suppressor 4 and the cover 1.

Figure 2:
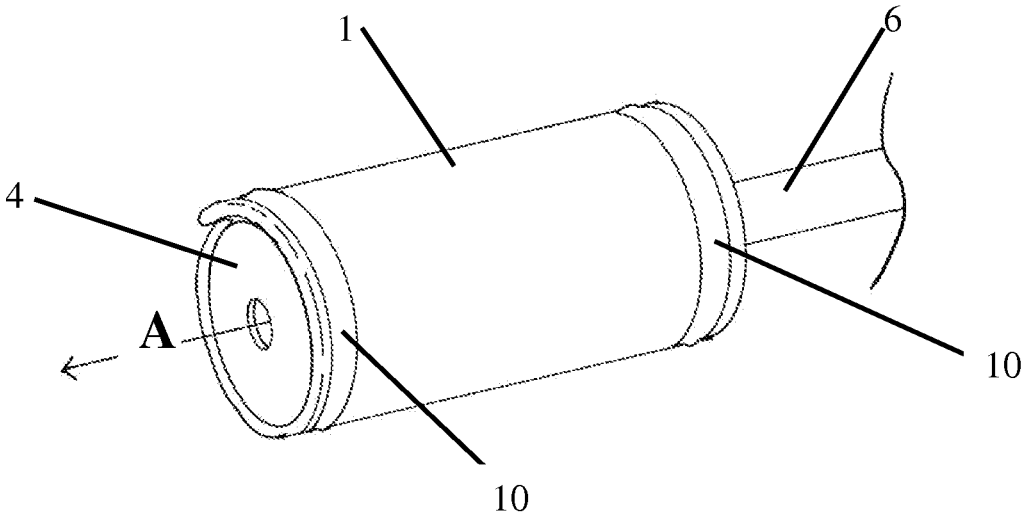
FIG. 2 shows a suppressor cover according to an embodiment, with the cover attached to a suppressor.

FIG. 2 shows a suppressor cover according to an embodiment, with the cover attached to the suppressor.

The figure shows the barrel 6 of the firearm, the suppressor 4 and the cover 1, as well as channels 10 in an outer surface of the cover.

Figure 3:
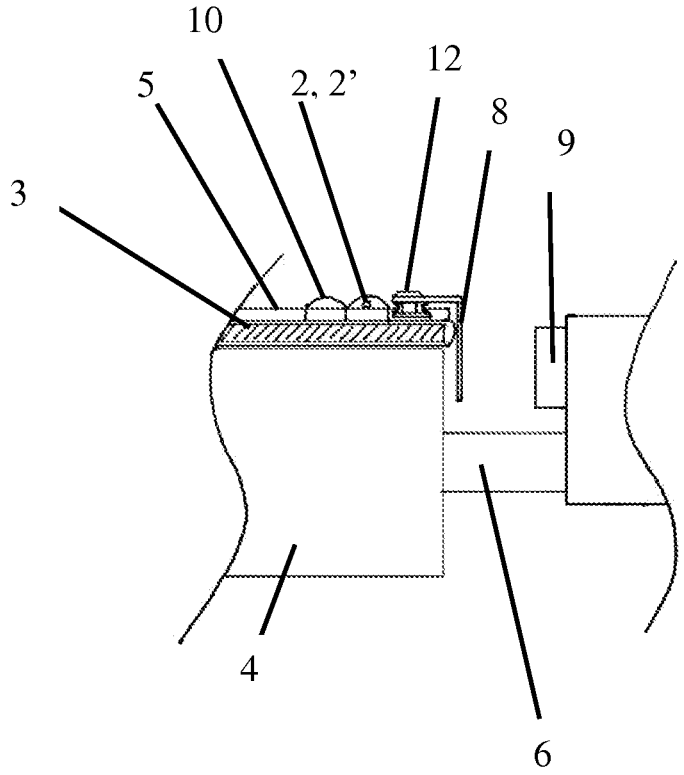
FIG. 3 shows a lateral cross-section of a rear part of a suppressor cover according to an embodiment and of the suppressor.

FIG. 3 shows a lateral cross-section of a rear part of a suppressor cover according to an embodiment and of the suppressor.

The figure shows a barrel 6 of the firearm, the suppressor 4 and the parts of the cover: a thermal insulator 3, an outer surface 5 of the cover, a channel 10 sewn into the outer surface of the cover, a spring 2, 2' placed into the channel in the outer surface of the cover, a gas shield 8, and a screw 12 for attaching the gas shield. Further, the figure shows a waste gas port 9 of the firearm.

Figure 4:
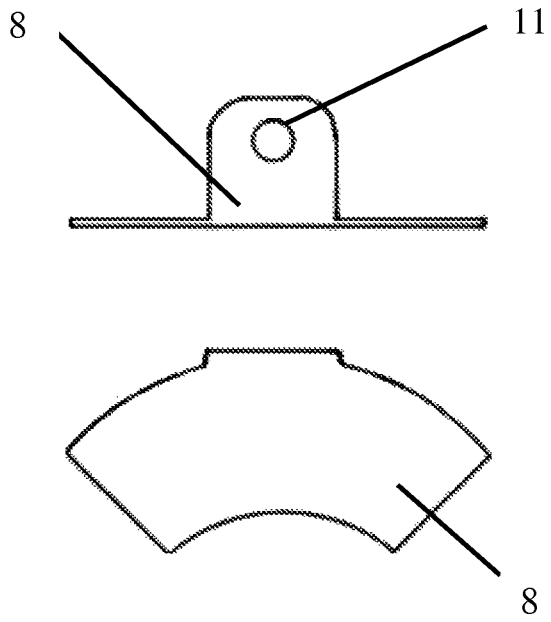
FIG. 4 shows an example of a gas shield, as viewed laterally and from above.

FIG. 4 shows an example of a gas shield 8, as viewed laterally and from above. The upper part of the gas shield has a hole 11 for attaching the gas shield 8.

The gas shield, attached to the rear part of the cover, protects the gas port of the firearm from waste gases. The gas shield 8 can prevent the overflow of hot high pressure gases released from the waste gas port 9 of a gas-piston-operated firearm from tearing (the outer surface fabric 5 of) the cover.

The top fabric of the rear part of the cover may have a hole for a screw 12, the hole reinforced by a metal ring or by circumferential sewing. A transport loop or the gas shield 8 may be attached to the hole. The gas shield is, for example, a metal or other durable, small-sized shield-like plate which protects the rear end of the cover when firing with a firearm having a short barrel and a gas piston waste gas port that directs excess hot high pressure gases forward towards the mouth of the barrel and the thereto attached suppressor and suppressor cover. A discharge of excess hot high pressure gases may damage soft or fabric suppressor covers.

It must be noted that the gas shield 8, discussed above in connection with FIGS. 3 and 4, is well suited for use with the suppressor covers disclosed in FIGS. 1A-1C, 2 and 3, but the gas shield 8 may well be also utilized with other types of suppressor covers.

Figure 5A:
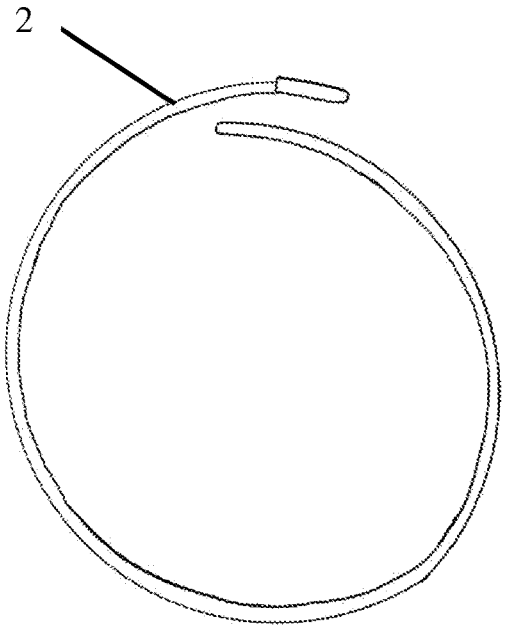
FIG. 5A shows a curved spring according to an embodiment, as viewed from the front.

FIG. 5A shows a curved spring 2 according to an embodiment, as viewed from the front. The figure shows an example of the shape of a ring which is open at one point or of the circular shape of the spring 2, into which shape the spring is pre-bent to achieve the compression effect.

Figure 5B:
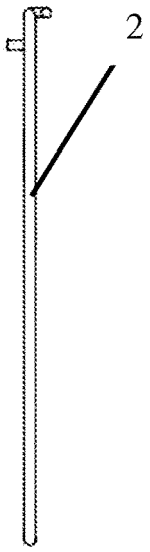
FIG. 5B shows a curved spring according to an embodiment, as viewed laterally.

FIG. 5B shows a curved spring 2 according to an embodiment, as viewed laterally.

Figure 5C:
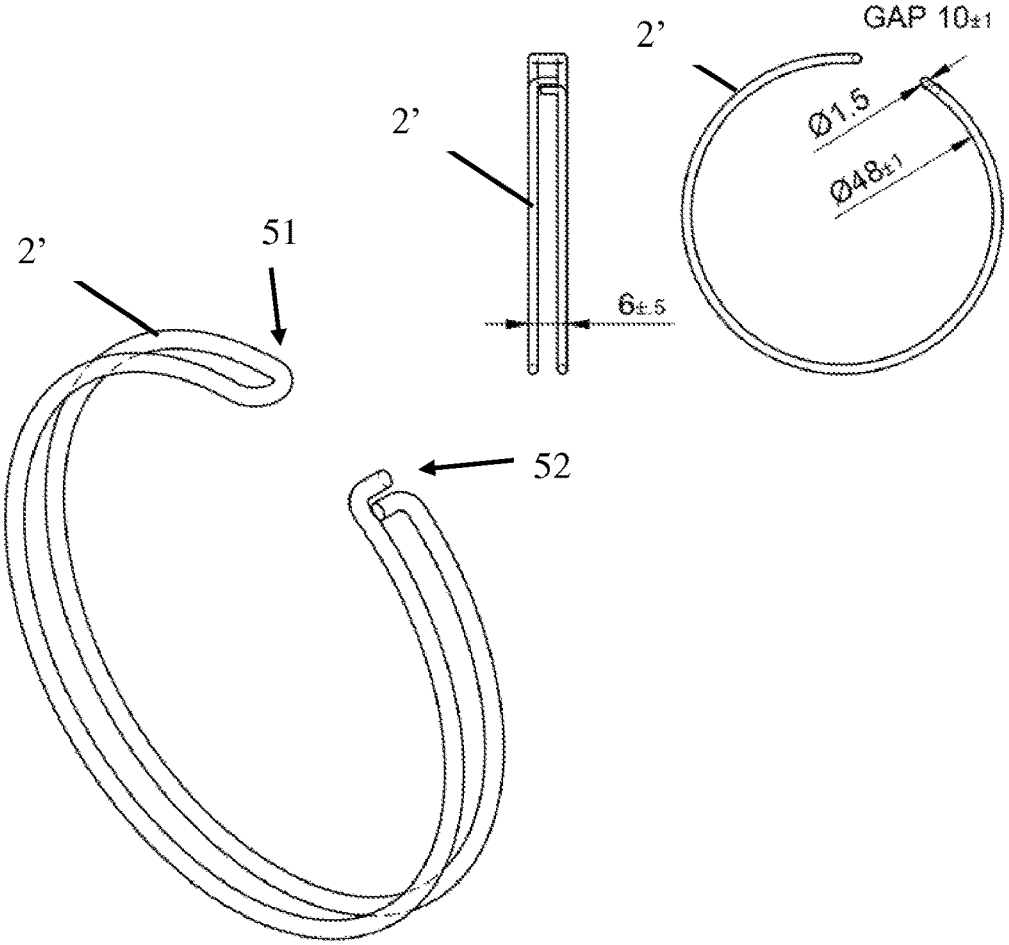
FIG. 5C shows a curved spring according to an embodiment, as viewed from various directions.

FIG. 5C shows a curved spring 2' according to an embodiment, as viewed from different directions. The figure shows another example of the shape of a ring which is open at one point or of the circular shape of the spring 2', into which shape the spring is pre-bent to achieve the compression effect.

Additionally or alternatively, the shape of the spring 2' may be described by defining that the spring 2' is pre-bent into the shape of a letter C. The spring 2' may be described, for example, by the term C-shaped clamp. The spring 2' comprises two substantially parallel portions shaped like the letter C that are fixedly connected to each other at their one end 51 and are free of each other at their other end 52. The spring 2' can thus be manufactured by bending from one continuous metal wire. The free ends of the spring help the spring 2' remain in place in the cover, because the free ends grasp the fabric of the cover, when the spring 2' is inserted into a channel of the cover.

The spring 2, 2' may be manufactured, for example, from a metal wire or metal ribbon. The metal wire may be, for example, a metal wire with a round cross-section. The metal wire may be, for example, a steel wire.

According to the example of FIG. 5C, the diameter of the metal wire of the spring 2, 2' may be, for example, 1.5 mm, the parallel portions shaped like the letter C may be, for example, 5.5-6.5 mm from each other, and the diameter of the portion shaped like the letter C or the circular shape may be, for example, 47-49 mm. A spring with these dimensions is well suited for compressing the cover around a suppressor that is, for example, 39-42 mm in diameter. It must be noted however, that these are only non-limiting examples, and other dimensions may also be used.

Using a spring comprising two parallel, same-shaped circular portions, it is possible to achieve, for example, better grip and better adaptability to suppressor shapes than with a single wire-like or ribbon-like spring.

The difference between the thermally insulating, self-tightening cover disclosed herein and other suppressor covers and thermal covers is that the cover disclosed herein enables the removal, attachment or tightening of a hot suppressor without any special arrangements, such as changing gloves or using another heat-resistant textile. In addition to this, the cover disclosed herein enables the transportation of the suppressor in combat gear while hot. This solution is implemented by using together compressive springs, built inside the cover, as well as a heat-resistant thermal insulator material.

The cover disclosed herein resolves the problem of thermally insulating suppressor covers such that the cover disclosed herein enables the use of the suppressor in demanding conditions due to such structural solutions, in which the suppressor cover casing does not melt or lose its characteristics in heavy firing, where the temperature of the suppressor can rise to more than 500 degrees Celsius. In addition to this, the insulation material with high thermal insulation capacity as well as simple and durable attachment to the suppressor enables the handling and removal of the suppressor when the suppressor is hot, the attachment and also the tightening of the suppressor, even while firing. The target temperature of the cover casing surface is below 140 degrees Celsius when the suppressor is over 500 degrees Celsius, and this has been achieved in test firings.

The cover disclosed herein resolves the problem such that it enables the detaching of the suppressor by a quick release or the detaching of the suppressor from the firearm. At the same time, the cover disclosed herein enables the transportation of the hot suppressor in combat gear or on a firearm without it damaging other equipment or causing burn injuries to a user. The cover disclosed herein can also reduce the visible heat signature emitted by the firearm suppressor.

A firearm suppressor fits inside the cover disclosed herein, and the cover remains on the suppressor due to the compression caused by the curved springs. The firearm suppressor cover flexes according to the diameter of the suppressor and flexes when threaded over the suppressor or when removing it such that the cover is able to move off the suppressor when the curved springs are opened, for example, by twisting manually.

The curved springs hold the suppressor cover in place while in use.

According to an embodiment, a method is provided for covering a firearm suppressor, comprising the following steps:

a) using for covering a cover comprising a thermal insulator and a curved spring located at a first end of the cover and pre-bent into a shape of a ring, which is open at one point. The spring provided herein is a spring as described in the foregoing.

b) placing the cover around the firearm suppressor, wherein the spring automatically tightens around the firearm suppressor and tightens the thermal insulator around the firearm suppressor. At the same time, the spring prevents, or at least reduces, longitudinal movement of the cover in relation to the suppressor.

The foregoing description provides non-limiting examples of some embodiments. It is however clear to a person ordinarily skilled in the art that the invention is not restricted to the disclosed details, but the invention can be implemented in other equivalent ways. For example, it should be appreciated that in the disclosed methods, the order of individual steps can be changed and some steps can be repeated a number of times or be completely omitted. It should also be appreciated that in this document terms comprise and include are open expressions not intended to be restrictive.

Furthermore, some of the features of the afore-described embodiments may be employed without the corresponding use of other features. As such, the disclosed description shall be considered as merely illustrative of the principles of the present invention, and not in limitation thereof. Hence, the scope of the invention is only restricted by the appended patent claims.

The invention claimed is:

1. A firearm suppressor cover, comprising:

a thermal insulator which is, in use, configured to surround a firearm suppressor; characterized in that the cover comprises:

a curved spring which is located at a first end of the cover and pre-bent into a shape of a ring, which is open at one point, the spring being, in use, configured to tighten around the firearm suppressor in order to tighten said thermal insulator around the firearm suppressor and to prevent a longitudinal movement of said cover in relation to said suppressor, wherein said spring comprises two substantially parallel portions shaped like a letter C that are fixedly connected to each other at their one end and are free of each other at their other end.

2. A cover according to claim 1, wherein said spring is, in use, configured to tighten around the firearm suppressor at a point, where the diameter of the suppressor changes.

3. A cover according to claim 1, wherein said spring is, in use, configured to tighten behind the suppressor.

4. A cover according to claim 1, wherein said spring is, in use, configured to tighten at a step-like point of the suppressor.

5. A cover according to claim 1, wherein said spring is manufactured from a metal wire with a round cross-section.

6. A cover according to claim 1, wherein said spring is configured to tighten said thermal insulator around suppressors having different diameters.

7. A cover according to claim 1, wherein said spring is removably attached to said cover.

8. A cover according to claim 1, wherein said thermal insulator is sewn in between fabrics.

9. A cover according to claim 1, wherein the cover further comprises a second spring located at a second end of said cover.

10. A cover according to claim 1, wherein the cover comprises three of said curved springs at different points in said cover.

11. A firearm suppressor cover, comprising:

a thermal insulator which is, in use, configured to surround a firearm suppressor; characterized in that the cover comprises:

a curved spring which is located at a first end of the cover and pre-bent into a shape of a ring, which is open at one point, the spring being, in use, configured to tighten around the firearm suppressor in order to tighten said thermal insulator around the firearm suppressor and to prevent a longitudinal movement of said cover in relation to said suppressor, wherein said spring is removably attached to said cover, and wherein said cover comprises two or more channels for attaching said spring to different points in said cover.

12. A cover according to claim 11, wherein said spring is, in use, configured to tighten around the firearm suppressor at a point, where the diameter of the suppressor changes.

13. A cover according to claim 11, wherein said spring is, in use, configured to tighten behind the suppressor.

14. A cover according to claim 11, wherein said spring is, in use, configured to tighten at a step-like point of the suppressor.

15. A cover according to claim 11, wherein said spring is pre-bent into the shape of a letter C.

16. A firearm suppressor cover, comprising:

a thermal insulator which is, in use, configured to surround a firearm suppressor; characterized in that the cover comprises:

a curved spring which is located at a first end of the cover and pre-bent into a shape of a ring, which is open at one point, the spring being, in use, configured to tighten around the firearm suppressor in order to tighten said thermal insulator around the firearm suppressor and to prevent a longitudinal movement of said cover in relation to said suppressor, wherein the cover further comprises: a gas shield which is configured to protect from waste gases of a gas port of a firearm and which is attached to a rear part of the cover.

17. A cover according to claim 16, wherein said spring is, in use, configured to tighten around the firearm suppressor at a point, where the diameter of the suppressor changes.

18. A cover according to claim 16, wherein said spring is, in use, configured to tighten behind the suppressor.

19. A cover according to claim 16, wherein said spring is, in use, configured to tighten at a step-like point of the suppressor.

20. A cover according to claim 16, wherein said spring is pre-bent into the shape of a letter C.

* * * * *